United States Patent [19]

Sutton et al.

[11] Patent Number: 4,672,231

[45] Date of Patent: Jun. 9, 1987

[54] CONTROL CIRCUIT PARTICULARLY ADAPTED FOR USE WITH LUBRICATION SENSOR APPARATUS

[75] Inventors: Walter T. Sutton; Randy Craft; Stanley F. Kummer, all of Lexington, Ky.

[73] Assignee: Texas Instruments Incorporated, Dallas, Tex.

[21] Appl. No.: 818,835

[22] Filed: Jan. 14, 1986

[51] Int. Cl.[4] ..... H01H 35/18; F04B 49/02

[52] U.S. Cl. ..... 307/118; 417/13

[58] Field of Search ..... 307/118; 318/481; 361/27-29; 417/13, 19, 38, 44, 281, 282; 200/81 R, 81.9 R

[56] References Cited

U.S. PATENT DOCUMENTS

| | | | |
|---|---|---|---|
| 2,793,803 | 5/1957 | Yerger | 417/13 |
| 3,673,811 | 7/1972 | Adams et al. | 417/13 |
| 4,000,450 | 12/1976 | Nurnberg | 307/118 |
| 4,017,778 | 4/1977 | Koch | 318/481 |
| 4,028,593 | 6/1977 | Newell | 318/481 |
| 4,042,966 | 8/1977 | Newell et al. | 361/29 |
| 4,551,069 | 11/1985 | Gilmore | 417/13 |

*Primary Examiner*—Vit W. Miska

*Attorney, Agent, or Firm*—John A. Haug; James P. McAndrews; Melvin Sharp

[57] ABSTRACT

A pressure sensor probe has a first port connectable to a relatively low pressure source in a compressor crankcase and a second port connectable to a relatively high pressure source at the output of an oil pump. A shuttle is slidably disposed in a bore and has a first end which closes the first port when the difference in pressure between the two ports indicative of normal operation exceeds a selected value determined by the relative areas of the shuttle exposed to the respective pressures and by a coil spring which biases the shuttle away from the first port. A passage is formed between the shuttle and the bore leading from the second port to a force receiving surface on the high pressure side of the shuttle. The length and cross sectional area of the passage is selected to provide a desired dampening or time delay between the high pressure source and the force receiving surface. A control circuit includes a reed switch whose state of actuation is dependent upon the position of the shuttle. The control circuit processes the input signal from the reed switch to control the energization of the compressor motor.

6 Claims, 5 Drawing Figures

CONTROL CIRCUIT PARTICULARLY ADAPTED FOR USE WITH LUBRICATION SENSOR APPARATUS

This application relates to subject matter included in copending application Ser. No. 818,836 assigned to the assignee of the instant invention and filed on the same date therewith.

This invention relates generally to pressure sensing apparatus and more particularly a to control circuit for controlling the energization of a compressor motor based on the value of the pressure differential between two pressure sources.

In relatively large sealed piston type refrigerant compressors, for example in the order of five ton compressors, it is conventional to monitor lubrication pressure generated by an oil pump in order to prevent compressor operation when there is insufficient lubrication which would result in undue wear and even seizing up of the compressor.

Conventionally lubrication pressure is monitored by using a pair of bellows type gauge pressure sensors. One sensor is connected to the crankcase through a thin capillary tube while the other sensor is connected through such a tube to an output port of the oil pump. The two sensors are typically mechanically linked by means of a balanced beam. The balance can be changed by means of coil springs which are adjustable to yield imbalance if relative oil pressure value drops below a desired value.

Crankcase pressures vary and pulsate over a wide range dependent on temperature and type of thermal loading of the refrigeration system. The pressures also fluctuate with each reciprocation of each cylinder and with the movement of each lobe or tooth of the oil pump (e.g. 120 Hz). The dampening effect of the capillary tubes in combination with the relatively high mass of the sensors and linkage elements as well as mechanical friction causes this type of system to filter these variations rapidly, changing pressure fluctuations which would cause excessive wear of sensor components or premature indication of oil pressure loss. However, not only does mechanical vibration cause a high incident of capillary tube fracture, sensors of this type inherently have a high material content due to the relatively high forces to which they are subjected. That is, such sensors measuring gauge pressure are exposed to atmospheric pressure and need to be able to prevent freon leakage.

It has been proposed to locate a sensor within the oil pump housing itself to eliminate the need for external plumbing. For example, in U.S. Pat. No. 4,551,069 a piston is shown disposed in a tube separating the interior of the tube into a high pressure portion which communicates with the output of the oil pump and a low pressure portion which communicates with the suction of the oil pump. The piston is adapted to move into and out of engagement with a movable contact arm of a switch. However this arrangement results in excessive wear of the movable sensor parts due to the continuous movement of the piston with the cyclical pressure fluctuations mentioned above as well as the need for some other means to prevent nuisance tripping of the compressor motor if it is used to control the energization thereof as suggested in the patent. Further, the provision of switching electric current in an oil and freon environment is undesirable.

In copending application Ser. No. 818,836 referenced above, an elongated sensor probe is provided with a bore having a first port at a first end thereof and a second port spaced axially from the first port. The probe is receivable in a threaded well of the oil pump housing with the lower end of the probe projecting into the crankcase of the compressor with the first port in communication therewith. The second port, radially located in the wall defining the bore, is connected to the output of the oil pump. A shuttle is slidably received in the bore with a coil spring disposed between the shuttle and a combination stop and sealing surface formed at the first end of the bore. The spring places a bias on the shuttle tending to move it away from the first end. A second stop is formed at the opposite end of the bore to limit movement of the shuttle in that direction and to ensure that the second port is never blocked. A piston is integrally attached to the shuttle at its distal end and a passage having a selected length and cross sectional area is formed between the second port and the force receiving surface so that a certain period of time is required for oil to flow between the second port and the force receiving surface of the piston. Indication means responsive to the position of the shuttle in the form of a permanent magnet is formed adjacent the distal end of the piston and a reed switch is mounted on a probe adjacent to the second end of the bore to provide an indication of the differential pressure existing between the two ports.

When the oil pump is generating more pressure than the combination of the effective pressure of the crankcase oil and the coil spring, the shuttle will move toward the first end with the lower surface of the shuttle contacting the first stop and effectively closing the first port. In this position the magnet is in its lower most position and the normally closed reed switch is closed indicating normal lubricating function.

When the differential pressure between the ports decreases to a point below the calibrated level (calibrated through the relative force receiving areas on opposite sides of the shuttle and the spring rate of the coil spring) then the shuttle will move away from the first end and the magnet will move to a position to cause the reed switch to open to deenergize a circuit indicating a loss of lubricating function.

In conventional systems when the pressure differential signal has been used to directly control energization of a compressor rather than to merely provide a visual or auditory alarm condition thermal relays have been used to provide this control because of inherent characteristics of such relays in order to provide selected operating conditions. For example, upon initial energization of the compressor a certain amount of time is required for normal operating pressure level to be attained. A thermal relay comprising, for example, a wire wound heater thermally coupled to a bimettalic element or a wax transducer whose energization is controlled by the pressure switch can provide a suitable time delay to allow pressure build up. When an insufficient pressure condition exits, the heater is energized which in turn, after a given time period, will cause actuation of the bimetal or transducer which in turn can be used to control the energization of the compressor. In addition to allowing time for normal pressure build up, such relays also prevent nuisance tripping for a momentary low pressure condition caused by a temporary condition, e.g. shock or vibration.

Another useful characteristic that the thermal relays provide is their ability to accumulate heat and thus decrease the period of the time delay upon repetitive on-off operation. That is, if the compressor has been running for some time generally just above the minimum safe pressure it is desirable to shorten the time delay. Running close to the minimum will normally result in at least short periods where the pressure will drop below the minimum to cause heater energization. Thus the bimetal or actuator will already be partly heated when a prolonged alarm condition occurs and will respond more quickly.

Although such thermal relays are effective they are limited in several respects. The thermal stresses and mechanical movement tend to limit the useful life of the relays and adversely affect their reliability. Timing characteristics also tend to vary from device to device more than is desirable.

It is therefore an object of the present invention to provide a control means which can control the energization of a compressor based on a selected profile of differential pressure between pressure generated by an oil pump and that contained in a compressor crankcase which is long lasting and reliable. It is another object to provide a control circuit responsive to on-off signals of a pressure switch which has characteristics corresponding to those of conventional thermal relays. It is yet another object to provide a control circuit receiving on-off input signals which will provide a delayed opening of output control signals based on the type and duration of the signal input and one which has a contact memory feature to maintain the state of the output contacts if power is removed from the circuit.

Another object is the provision of a control circuit which is particularly useful with the pressure sensor apparatus set forth in application Ser. No. 818,836 referenced supra.

The above and other objects, features and advantages of the present invention will become apparent from the following description and the appended claims, taken in conjunction with the accompanying drawings which show by way of example the preferred embodiment of the present invention and in which like component parts are designated by like references numerals throughout the several figures.

SUMMARY OF THE INVENTION

Briefly, in accordance with the invention differential pressure sensor switch contacts are coupled to a rectified power supply with a resistor and timing capacitor coupled as an R-C circuit across the contacts. A unijunction transistor connected to the RC circuit is adapted to pulse the set coil of a two coil, pulse operated latching type relay. The relay contacts are placed in the gate circuit of a triac which has its main electrodes connected to the contactor circuit of the compressor so that gating of the triac in turn controls the energization of the compressor.

Opening of the sensor switch contacts causes the timing capacitor to start charging which, when it reaches a selected percentage of the voltage supply, fires the unijunction transistor causing the set coil to be pulsed and the relay contacts to open thereby turning off the triac and compressor.

A reset capacitor is connected through a reset button between the power supply and the reset coil so that depression of the reset button will cause the capacitor to pass the ramp up in the form of a pulse to the reset coil to close the relay contacts in a trip free fashion and turn on the triac and reenergize the compressor. The reset capacitor is also connected to the base of a transistor connected across the timing capacitor to provide a discharge path whenever the reset coil is pulsed.

BRIEF DESCRIPTION OF THE DRAWINGS

In the accompanying drawings.

DETAILED DESCRIPTION

Figure 1:
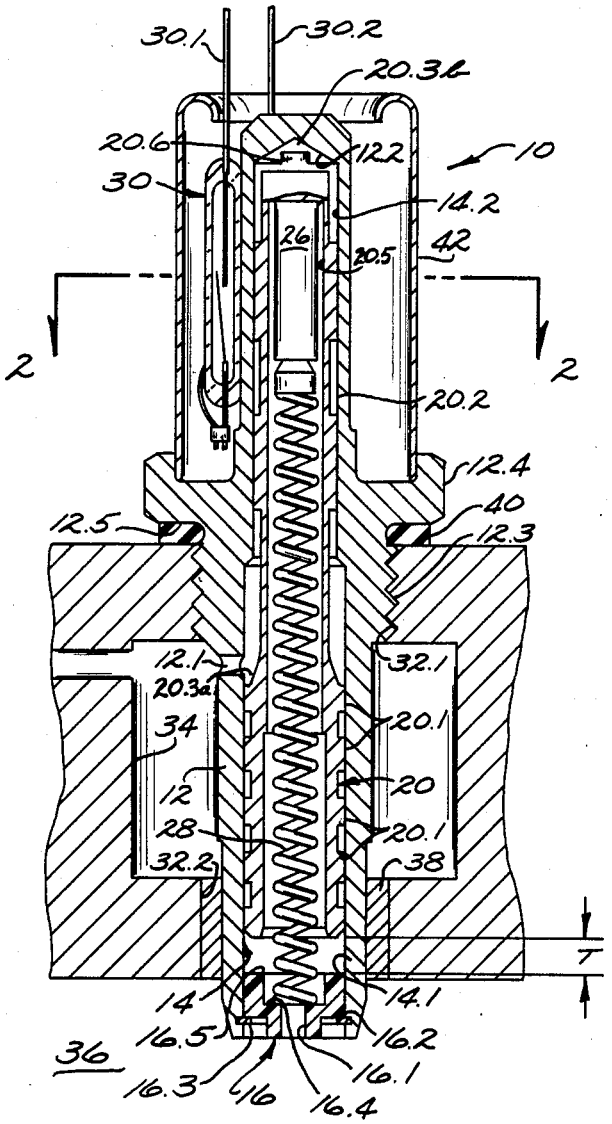
FIG. 1 is a cross sectional view taken through the longitudinal axis of the probe mounted in the well of an oil pump housing.
Figure 2:
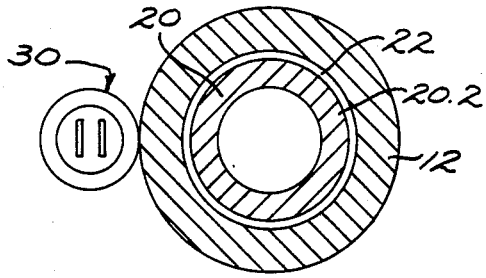
FIG. 2 is a cross sectional view taken on line 2—2 of FIG. 1 showing the reed switch and the piston of the sensor.
Figure 3:
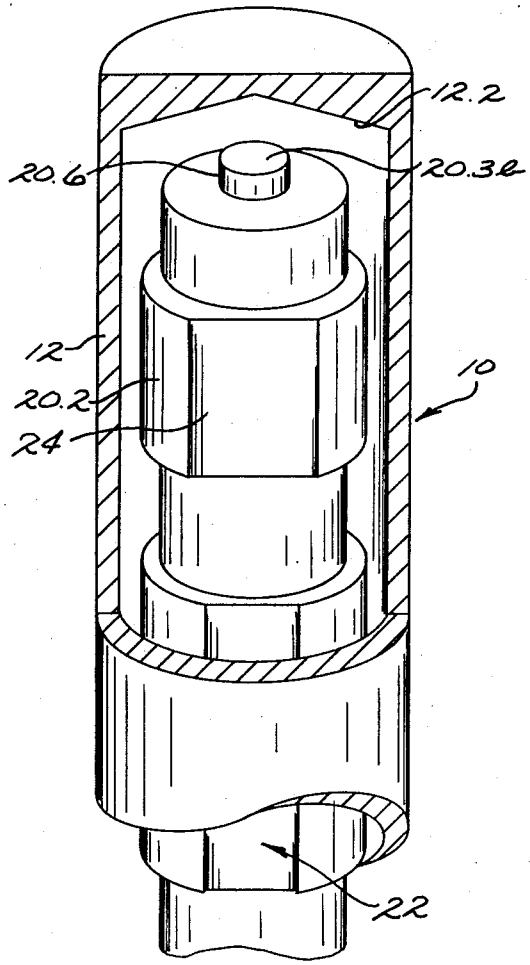
FIG. 3 is a perspective view, partly broken away, of the piston and second end of the bore in which the piston is disposed.

With particular reference to FIGS. 1–3 numeral 10 is used to designate generally a sensor probe made in accordance with application Ser. No. 818,836 referenced supra, and for which the control circuit is particularly adapted. The probe comprises an elongated generally cylindrical housing 12 formed of nonmagnetic material such as free cutting naval brass formed with a bore 14 extending essentially from bottom to top. Bore 14 has a large diameter portion 14.1 at its bottom and a smaller diameter portion 14.2 at its top. Bore 14 is closed at its bottom by a plug 16 which is provided with a first port 16.1 extending through the plug and preferably aligned with the longitudinal axis of bore 14. Plug 16 is retained in bore 14 in any suitable manner as by threading the bottom portion of bore 14 and the outer periphery of the plug or, as shown, by forming a circumferential groove 16.2 in housing 12 in communication with bore 14 and placing a retaining ring 16.3 in the groove. Plug 16 is formed with a recessed spring seat 16.4 and a sealing surface 16.5. Preferably plug 16 is formed of Teflon or other suitable material which forms an effective sealing surface.

Figure 1A:
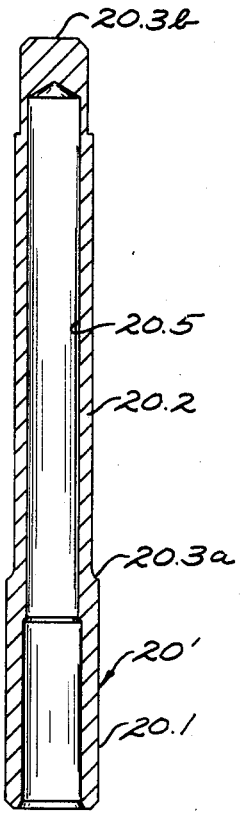
FIG. 1*a* is a cross sectional view taken through the longitudinal axis of a modified combination shuttle-piston useful in the FIG. 1 sensor.

A shuttle 20 formed of free cutting naval brass or other nonmagnetic material is slidably disposed in bore portion 14.1 and is formed with outer peripheral sealing surfaces 20.1 to effectively form a seal with the side wall defining bore 14.1. FIG. 1 shows a plurality of annular recesses spaced axially along shuttle 20 in the sealing surfaces 20.1 as well as in the dampening passage area to be discussed below in order to provide space for contaminants and the like which might otherwise tend to mar the surfaces if caught between the shuttle and the bore. Alternatively, the sealing surface 20.1 and passageway surfaces may be formed without such recesses if desired as shown in FIG. 1*a*.

A second port 12.1 is formed in the side wall defining bore 14 and extends in a radial direction through the side wall at a location spaced axially from the port 16.1 such that shuttle 20 is able to slide up and down a selected distance between the two ports. Surface 16.5 of plug 16 forms a stop for the shuttle when moving in the downward direction as see in FIG. 1 and upper stop surface 12.2 limits upward movement as seen in FIG. 1.

Shuttle 20 is itself formed with a bore 20.5 extending along its longitudinal axis essentially along its entire length but closed at its top end portion. A permanent magnet 26 is disposed at the closed end of bore 20.5 and is biased thereagainst by a coil spring 28 which extends from seat 16.4 to the magnet 26.

Shuttle 20 is provided with an extension 20.2 which may be integrally formed with the main body. Extension 20.2 serves as a piston and has a force receiving surface 20.3 at its free distal end. Force receiving surface 20.3 is formed of first and second portions 20.3 a and b. When the piston is fully seated against stop 12.2 only portion 20.3*a* is exposed to the high pressure oil but as soon as the piston moves away from the stop, both portions 20.3*a* and *b* are exposed to the high pressure oil to greatly increase the force tending to move the shuttle toward stop 16.5. Thus a first level of high pressure is required to move the piston away from stop 12.2 and once this happens, the increased area results in a significantly larger force being placed on the piston to move it downwardly to thereby avoid any possible chattering tendency which might occur if the pressure hovered at the calibrated level.

The mass of shuttle 20 in combination with the spring rate of spring 28 is selected to yield a natural frequency of less than 20 Hz which makes the sensor insensitive to the 120 Hz main frequency of differential pressure pulsation generated by the oil pump and compressor piston. To further lower the response time of shuttle 20 to less than 1 Hz a passageway 22 having a selected length and cross sectional area is formed between extension 20.2 and the side wall of housing 12 which defines bore 14.2 which can be seen in FIG. 2 as an annular space. The length of the passage and its cross sectional area as well as the ratio between area 20.3*a* and 20.3*b* determine the dampening effect that the sensor has relative to the pressure fluctuations. By way of example in a sensor constructed in accordance with the invention shuttle 20' of FIG. 1*a* including extension 20.2 was 2.50 inches long of which extension 20.2 comprised 1.75 inches. The outer diameter of the large diameter portion which comprises the major portion of the length of extension 20.2 was approximately 0.2480 inches. The diameter of bore 14.2 was approximately 0.2500 inch. The difference in diameters of bore 14.2 and extension 20.2 therefor resulted in a clearance of 0.002 inch for passage 22 (FIG. 2). If it is desired to lessen the dampening effect the outer peripheral surface of the generally cylindrical extension can be provided with a flattened portion 20.4 extending parallel to the longitudinal axis as seen in FIG. 3 thereby increasing the cross sectional area.

In order for the lubrication pressure to exert its force onto force receiving surface 20.3*b*, the oil has to make its way through the passage into the chamber at the top end of the bore. The viscosity of the oil, the length and cross sectional area of the passage, the amount of the differential pressure and the length of motion of shuttle 20 between its stops (distance "t" shown in FIG. 1) determine the time the shuttle requires to move to the bottom stop. As the differential pressure decreases below the selected or calibrated value, the portion below that level in effect attempts to reset the shuttle to the top stop position however the oil at the top of the bore has to be displaced back through the passage thereby resulting in a very slow reset motion.

A reed switch 30 is mounted on housing 12 adjacent to the upper end of bore 14.2 and has first and second electrical contacts adapted to move into and out of engagement in response to the position of magnet 26. The position of shuttle 20 and concomitantly magnet 26 is determined by the differential in the pressure of oil between the two ports 16.1 and 12.1. When the differential is greater than the selected or calibrated value then the shuttle moves downwardly until limited by surface 16.5 which acts both as a stop and as a seal effectively closing port 16.1. This is the position of shuttle 20 during normal operation of the compressor. In that position magnet 26 would be in its lowermost position allowing the reed contacts to move to their normally closed position energizing a circuit through leads 30.1 and 30.2 indicative that normal lubrication is being provided. When the differential decreases below the calibrated level, shuttle 20 moves upwardly under the influence of the oil pressure received through port 16.1 and the bias of spring 28 until motion of the shuttle is limited by stop surface 12.2. In that position magnet 26 is in its uppermost position thereby causing the reed switch contacts to open and deenergize the circuit indicating that a low pressure condition exists and that the lubrication function is impaired.

Calibration of the sensor is dependent upon the relative force receiving areas, i.e. force receiving surface 20.3 on the high pressure side of piston 20.2 and the force receiving surfaces on the low pressure side of shuttle 20 including the bottom surface of the shuttle and the bottom surface of the closed end of bore 20.5 in addition to the force exerted by spring 28.

According to a sensor made in accordance with the invention, the spring was selected so that 15 psi differential pressure resulted in the calibrated level. That is, if the differential is higher than 15 psi, the shuttle 20 is at the stop 16.5 indicative of sufficient lubrication. If oil pressure drops below 15 psi, the shuttle will move toward stop surface 12.2 indicative of low lubrication pressure.

The length of the portion of shuttle 20 having sealing surface 20.1 is such relative to the location of projection 20.6 and stop surface 12.2 that port 12.1 is always open so that oil pressure at port 12.1 is always in communication with force receiving surface 20.3 of piston 20.2.

Housing 12 is formed with a threaded portion 12.3 intermediate its ends which is adapted to screw into a threaded bore 32.1 in the housing 32 of an oil pump. A well 34 is connected to the high pressure output of the oil pump. Another bore 32.2 leads to the low pressure crankcase 36 of a refrigerator compressor with the bottom tip portion of probe 10 extending into the crankcase so that port 16.1 is in communication therewith. A suitable seal 38 seals the crankcase from well 34.

Housing 12 is provided with a hexagonal portion 12.4 to facilitate screwing in of the probe and has a bottom surface 12.5 which forms a seal with packing washer 40 compressed between surface 12.5 and housing 32. Preferably a cylindrical sleeve 42 of steel or other ferromagnetic material is mounted on the top surface of hexagonal portion 12.4 and extends upwardly beyond the reed switch to provide magnetic shielding of the switch and sensor components.

Figure 4:
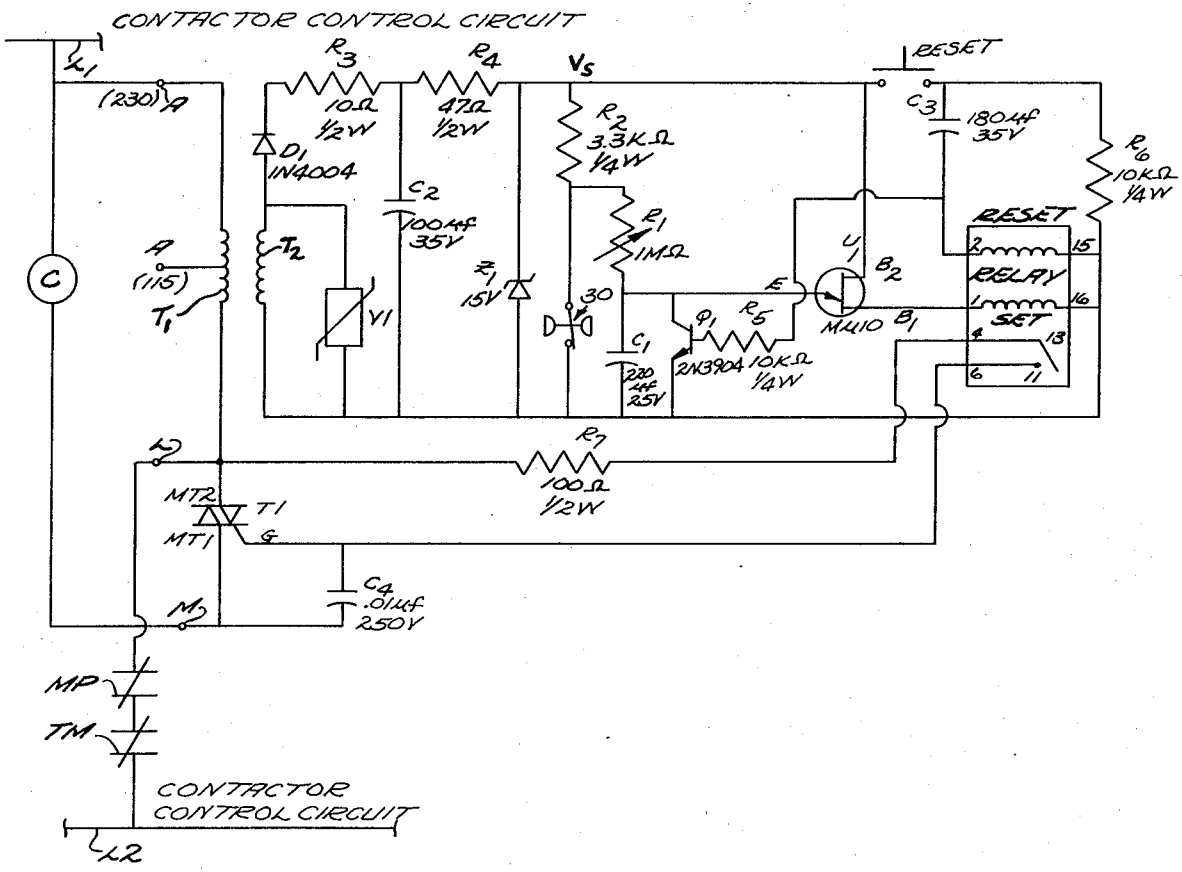
FIG. 4 is a circuit diagram of a control circuit in accordance with the present invention.

As seen in FIG. 4 a control circuit is shown which is particularly well suited for use with the pressure sensing apparatus depicted in FIGS. 1–3. The control circuit is connectable to the contactor control circuit of the compressor so that it obtains its power therefrom as well as enabling it to control the energization of the compressor. The contactor C is connected on one side to a contactor control supply line $L_1$ and to control circuit plug in point M. Control circuit point M is connected through the main electrodes of a triac T1 to control circuit plug in point L and hence to the common $L_2$ of the contactor control circuit through conventional normally closed motor protector and thermostat contacts MP, TM. The primary winding T of a transformer is shown connected to the supply of the contactor control circuit at point A (230 volt) but alternatively could be connected at the tapped connection A (115 volt). The winding therefore is energized whenever the contactor control circuit is energized.

Secondary transformer winding $T_2$ is connected to a rectifying diode $D_1$ which in turn is serially connected to resistors $R_3$ and $R_4$. A varistor V1 is coupled around winding $T_2$ to provide transient suppression. Power supply capacitor $C_2$ used for smoothing out the rectified power supply is connected on one side between resistors $R_3$ and $R_4$ and on the other to the timing circuit common. Voltage regulating diode $Z_1$ is connected between the other side of resistor $R_4$ and the timing circuit common to provide a regulated voltage supply $V_s$ of 15 volts. Resistor $R_3$ limits current to capacitor $C_2$ and resistor $R_4$ limits current to zener diode $Z_1$. Resistor $R_2$ is serially connected to the reed switch 30 between $V_s$ and the timing circuit common with serially connected resistor $R_1$ and timing capacitor $C_1$ coupled around switch 30. A unijunction transistor $U_1$ has its emitter E connected between resistor $R_1$ and capacitor $C_1$ with its base $B_2$ connected to $V_s$ and its base $B_1$ connected to a bistable relay. A reset button is placed between $V_s$ and capacitor $C_3$ which in turn is connected to the relay. A Resistor $R_6$ is connected between $V_s$ beyond the capacitor $C_3$ to the timing circuit common.

An NPN transistor $Q_1$ is coupled across capacitor $C_1$ and has its base connected through a base current limiting resistor $R_5$ to a point between capacitor $C_3$ and the relay.

The relay is a conventional two coil latching type activated on a pulse. The relay has a set coil (1–16) which is connected between base $B_1$ of transistor $U_1$ and common and a reset coil (2, 15) connected between capacitor $C_3$ and common. The two coils control the position of a set of contacts 11, 13 with contact 13 connected to circuit control point L through current limiting resistor $R_7$. Contact 11 is connected to gate G of triac T1 with a noise filter capacitor $C_4$ connected between gate G and main electrode MT1.

Under normal system conditions, the differential pressure sensor contacts 30 shown in FIGS. 1, are closed. The relay contacts are in the closed position allowing the triac T1 gate circuit to conduct to thereby turn on the triac.

If an alarm condition occurs and the contacts of switch 30 open capacitor $C_1$ begins to charge until it reaches a threshold of about 0.7 $V_s$ and fires normally nonconducting unijunction transistor $U_1$. This discharges capacitor $C_1$ and sends a pulse to the set coil (1–16) to open the relay contacts and turn off the triac, thereby deenergizing the contactor and the compressor. Since the relay is bistable the triac will not conduct again until the reset button is closed causing capacitor $C_3$ to send a pulse (the ramp up voltage) to the reset coil (2–15) as well as turning on transistor $Q_1$ to discharge capacitor $C_1$.

This makes the control trip free since capacitor $C_3$ will only pass the initial pulse. The control cannot be overridden by taping down the reset button, for example.

During a sequence of operation in which the contacts of switch 30 have been opened because of a low pressure condition if the contacts close prior to the triggering of transistor $U_1$ capacitor $C_1$ will begin to discharge through resistor $R_1$. The discharge rate, as is true of the charge rate, is exponential with the time constant $R_1 C_1$ (for discharge) or $(R_1+R_2)\ C_2$ (for charge). Since the value of resistor $R_1$ is much larger than that of resistor $R_2$ the charge and discharge rate are essentially the same making the circuit a direct analog of conventional thermally operated controls which are also exponential in nature.

A control circuit built in accordance with the invention had the following components.

$D_1$ IN4004
V1 metal oxide varistor (39Z1)
$U_1$ 2N4871
$Q_1$ 2N3904
$Z_1$ Zener diode 15V
$C_1$ 220 μF 25V
$C_2$ 100 μF 35V
$C_3$ 100 μF 35V
$C_4$ 0.01 μF 250V
T1 Triac 2N6344A
$R_1$ 1M ohms Variable
$R_2$ 3.3K ohms ¼ w
$R_3$ 10 ohms ½ w
$R_4$ 47 ohms ½ w
$R_5$ 10K ohms ¼ w
$R_6$ 10K ohms ¼ w
$R_7$ 100 ohms ½ w
Relay Midtex type 327

Thus it will be seen that a control has been provided which provides operational stability and reliability. The control can easily be packaged in a metal enclosure for conduit mounting with large mass components directly anchored through a PC board to the enclosure to provide optimum vibration stability. The control provides a selected delayed opening which operates as an electrical analog of the thermally operated controls and provides contact memory.

While a specific embodiment of the invention has been illustrated and described herein it will be realized that numerous modifications and changes will occur to those skilled in the art.

What is claimed is:

1. A control circuit apparatus for controlling the state of energization of a compressor based on whether or not sufficient lubricating pressure exists in which a differential pressure sensor having movable sensor contacts adapted to close and open, the sensor sensing the difference in pressure between the output of an oil pump and the crankcase of the compressor and providing an on-off electrical signal dependent upon the level of the differential pressure with the contacts being closed when sufficient differential pressure is sensed comprising a bidirectional solid state switch having first and second main electrodes serially connected to means controlling the energization of the compressor, the solid state switch having a gate circuit, a pulse operated latching bistable relay having movable relay contacts in the gate circuit adapted to move into and out of engagement upon actuation of the relay, the relay having a set coil and a reset coil, a pulse received by the set coil opening the relay contacts and a pulse received by the reset coil closing the relay contacts, a control circuit voltage supply having a rectified current coupled to the sensor contacts, a resistor and timing capacitor connected as an R-C circuit coupled across the sensor contacts such that the timing capacitor charges when the sensor contacts open upon insufficient differential pressure and means responsive to the level of charge on the timing capacitor to actuate the relay and cause the relay contacts to open the gate circuit of the solid state switch and deenergize the compressor and means to reset the relay comprising a reset capacitor coupled between the reset coil and a reset button, the reset button adapted upon depression thereof to connect the reset capacitor to the rectified voltage source whereby depression of the reset button will cause a pulse to be transmitted to the reset coil to close the relay contacts.

2. Control circuit apparatus according to claim 1 in which the reset capacitor is also connected to the base of a transistor connected across the timing capacitor so that whenever the reset capacitor transmits a pulse, it turns on the transistor which provides a discharge path for the timing capacitor.

3. Control circuit apparatus according to claim 1 in which the means to actuate the relay is a unijunction transistor connected to the set coil.

4. Control circuit apparatus comprising a triac having two main electrodes and a gate, the main electrodes being serially connectable to a contactor control circuit to control the energization thereof, a pulse operated latching relay having a set coil, a reset coil and a pair of relay contacts which are openable when the set coil is pulsed and closable when the reset coil is pulsed, a power supply, a set of sensor contacts coupled to the power supply, a resistor and timing capacitor connected as an R-C circuit coupled across the sensor contacts, a unijunction transistor having an emitter connected to the R-C circuit and having an output connected to the set coil to provide a set pulse thereto, means for providing a reset pulse to the reset coil, the relay contacts coupled to the gate of the triac, whereby opening of the sensor contacts will cause the timing capacitor to charge and upon reaching a selected level of charge will fire the unijunction transistor and pulse the set coil to open the relay contacts and turn of the triac.

5. Control circuit apparatus according to claim 4 in which the power supply is rectified, a reset capacitor is connected between the reset coil and a reset button which in turn is connected to the rectified power supply whereby depression of the reset button will cause the reset capacitor to pulse the reset coil.

6. Control apparatus according to claim 5 in which a transistor is coupled across the timing capacitor to provide a discharge path, the reset capacitor being connected to the base of the transistor whereby the timing capacitor will be discharged through the transistor when the reset button is depressed and through the resistor of the RC circuit when the sensor contacts are closed.

* * * * *